US008986174B2

(12) United States Patent
Lien

(10) Patent No.: US 8,986,174 B2
(45) Date of Patent: Mar. 24, 2015

(54) BARBELL ASSEMBLY

(75) Inventor: Louis Lien, Bellaire, TX (US)

(73) Assignee: USA Sports, Inc., Houston, TX (US)

( * ) Notice: Subject to any disclaimer, the term of this patent is extended or adjusted under 35 U.S.C. 154(b) by 281 days.

(21) Appl. No.: 13/568,942

(22) Filed: Aug. 7, 2012

(65) Prior Publication Data

US 2014/0045661 A1 Feb. 13, 2014

(51) Int. Cl.

*A63B 21/072* (2006.01)
*A63B 21/075* (2006.01)
*A63B 21/00* (2006.01)

(52) U.S. Cl.

CPC ..... *A63B 21/0724* (2013.01); *A63B 21/0728* (2013.01); *A63B 21/1496* (2013.01); *Y10T 29/49881* (2013.01)

USPC ..... 482/107; 482/106

(58) Field of Classification Search

CPC ..... A63B 21/072; A63B 21/0724; A63B 21/0728; A63B 21/0557

USPC ..... 482/92–93, 104, 106–108, 94, 97, 109; 403/342, 343

See application file for complete search history.

(56) References Cited

U.S. PATENT DOCUMENTS

| | | | | | |
|---|---|---|---|---|---|
| 4,455,020 | A * | 6/1984 | Schnell | 482/106 |
| 4,579,337 | A * | 4/1986 | Uyeda | 482/107 |
| 4,638,994 | A * | 1/1987 | Gogarty | 482/107 |
| 5,062,631 | A * | 11/1991 | Dau et al. | 482/107 |
| 5,090,693 | A * | 2/1992 | Liang | 482/108 |
| 5,295,934 | A * | 3/1994 | Collins et al. | 482/107 |
| 5,464,379 | A * | 11/1995 | Zarecky | 482/108 |
| 5,628,716 | A * | 5/1997 | Brice | 482/106 |
| 5,911,651 | A * | 6/1999 | Liu | 482/108 |
| 6,770,016 | B1 * | 8/2004 | Anderson et al. | 482/106 |
| 6,837,833 | B2 * | 1/2005 | Elledge | 482/108 |
| 6,875,161 | B1 * | 4/2005 | Brice | 482/107 |
| 7,001,310 | B1 * | 2/2006 | Brice | 482/107 |
| 7,087,000 | B1 * | 8/2006 | Walker | 482/107 |
| 7,131,938 | B2 * | 11/2006 | Cao | 482/106 |
| 7,591,772 | B2 * | 9/2009 | Shillington | 482/107 |
| 2002/0091045 | A1 * | 7/2002 | Wince | 482/106 |
| 2007/0298939 | A1 * | 12/2007 | Anderson | 482/107 |
| 2013/0109545 | A1 * | 5/2013 | Chen | 482/107 |

* cited by examiner

*Primary Examiner* — Oren Ginsberg
*Assistant Examiner* — Andrew S. Lo
(74) *Attorney, Agent, or Firm* — Osha Liang LLP

(57) ABSTRACT

A barbell includes a bar assembly that includes a sleeve rotatably fitted over a rotating-locking mechanism at an end of a shaft; and an end cap attached to an open end of the sleeve to enclose the rotating-locking mechanism and the end of the shaft inside the sleeve, in which the rotating-locking mechanism includes a supporting ring rotatably fitted over the shaft and a joining ring attached to the end of the shaft, in which the supporting ring abuts, on one side, a shoulder on an inner surface of the sleeve and, on the other side, the joining ring.

16 Claims, 6 Drawing Sheets

FIG. 3
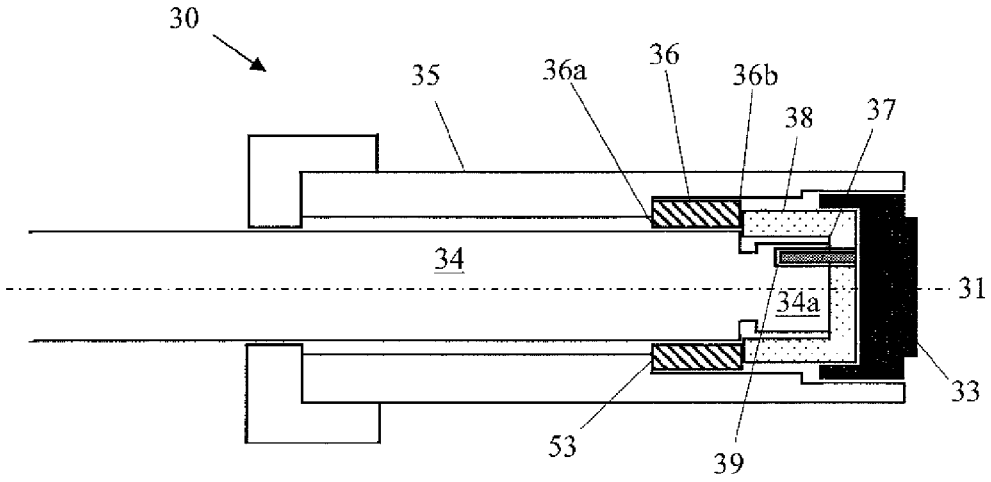
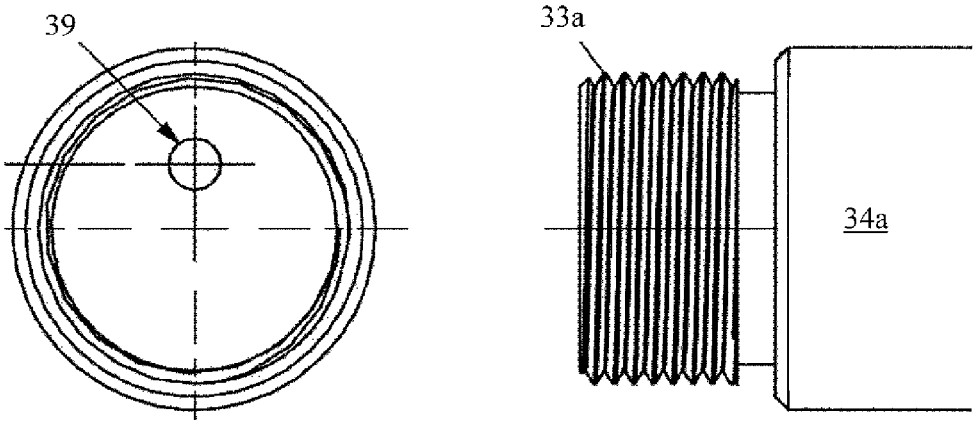
(A) (B)
FIG. 4

BARBELL ASSEMBLY

BACKGROUND OF INVENTION

1. Field of the Invention

The invention relates generally to exercise equipment. Specifically, this invention relates to weight-lifting equipment, such as Olympic bars.

2. Background Art

When one lifts a barbell from the ground to a position above one's head, the bar rotates 180 degrees. If weight plates do not rotate freely, they would generate a substantial torque that would be transmitted to the lifter's wrist/skeletal systems. Because the weights lifted by athletes may range from 100-500 lbs or more, such torque transfer not only can be painful, but also can cause an "overuse injury" to the athletes. For safety and comfort, barbells may be equipped with rotating sleeves to allow weight plates to rotate and to make strength training more productive and safer.

Olympic barbells (Olympic bars) are specially designed for professional use at Olympic games and other competitive events. Common features of Olympic bar designs include sleeves that can rotate freely and smoothly, while supporting the weight of the plates. This makes it easier for user to practice more "explosive" weight lifting.

An Olympic bar for men is about 2.2 m (7.22 ft) long and weighs about 20 kg (44.1 lbs). The outer ends (rotating sleeves) are about 50 mm (1.9685 in) in diameter for accommodating the weight plates, while the grip section is about 28 mm (1.1024 in) in diameter, and 1,310 mm (51.57 in) in length. A women's Olympic bar is similar to the men's bar, but is shorter—2.05 m (6.73 ft)—and lighter—15 kg (33.07 lbs)—with a smaller grip section diameter (25 mm).

To allow sleeves to rotate freely, Olympic bars typically incorporate bushings, ball bearings, or needle bearings in their rotation mechanisms. Because needle bearings have long, thin bearing elements that have more surface areas than ball bearings, needle bearings can take the weight loads better and are preferred over ball bearings. In addition, bushings are commonly used because of their durability and low maintenance.

In addition to the rotation mechanism, the Olympic bars also need to have a retention mechanism that allows the rotating sleeves to stay on a shaft (i.e., without longitudinal sliding), while allowing the rotating sleeves to have free rotation. Common retention mechanisms may include bolts, pins, or snap rings. An example that uses a bolt to secure a rotating sleeve to a handle bar is shown in FIG. 1, while an example that uses a roller pin is shown in FIG. 2.

FIG. 1 shows a cross-sectional view of a bar assembly 10 that uses a bolt to join the rotating sleeves and the shaft, as disclosed in U.S. Pat. No. 6,770,016 issued to Anderson et al. As shown, the bar assembly 10 includes a shaft 14 (a handle bar). A sleeve 12 is slide over the shaft 14. The sleeve 12 together with an end element 11 are retained on the shaft 14 by a bolt 16. The bolt 16 is threaded into a female threaded end portion 18 on the shaft 14. Once the bolt 16 is fixed at the end portion 18 of the shaft 14, it helps to retain the end element 11 and the sleeve 12 on the shaft 14 and prevent them from sliding off the end of the shaft 14.

To allow rotational freedom of the sleeve 12 around the shaft 14, the bolt 16 passes through a hole in the end element 11 and is then threaded into the end portion 18 of the shaft 14. The bolt 16 is inserted inline with the longitudinal axis of the shaft 14 (or the rotational axis of the sleeves 12) to allow the sleeve 12 to freely rotate around the shaft 14. However, sleeve rotation might from time to time exerts rotational force on the bolt 16. As a result, the bolt 16 may gradually come loose.

An alternative to a bolt is to use a roll pin or a snap ring to retain a rotating sleeve on a shaft. With this mechanism, a roll pin or a snap ring is lodged in matched grooves on the shaft and the rotating sleeve to prevent them from sliding in the longitudinal direction, while allowing rotational motions. FIG. 2 shows an example of a bar assembly 20 that uses a roll pin to retain a rotating sleeve on a handle bar.

As shown in FIG. 2, a bar assembly 20 includes a roll pin 26 to retain a sleeve 22 on a shaft 24. The roll pin 26 may be made by rolling a piece of metal in a way that it would exhibit elasticity such that it can be forced into a groove 28. Once lodged in the groove 28, the roll pin 26 can expand to lock the sleeve 22 on the shaft 24 to prevent the sleeve 22 from sliding off the end of the shaft 24. In a similar manner, a snap ring (in a form of an incomplete circle) can also be used (instead of a roller pin) to retain sleeve 22 on the shaft 24. In order to allow a roller pin 26 (or a snap ring) to fit into the groove 28, the thickness of the roll pin 26 must be smaller than the width of the groove 28. As a result, there is small gap (clearance) in the groove/roller pin setup. The gap allows the sleeve 22 to slide longitudinally on the shaft 24, albeit very slightly. In addition, while the grooves may be only millimeters deep, such grooves would weaken the bars and the sleeves.

While these prior art approaches to sleeve retentions on the shafts (e.g., using bolts, pins, and/or snap rings) are satisfactory in most situations, there is still a need for improved mechanisms to secure rotating sleeves on shafts.

SUMMARY OF INVENTION

One aspect of the invention relates to barbells. A barbell in accordance with one embodiment of the invention comprises a bar assembly that comprises a sleeve rotatably fitted over a rotating-locking mechanism at an end of a shaft; and an end cap attached to an open end of the sleeve to enclose the rotating-locking mechanism and the end of the shaft inside the sleeve, wherein the rotating-locking mechanism comprises a supporting ring rotatably fitted over the shaft and a joining ring attached to the end of the shaft, wherein the supporting ring abuts, on one side, a shoulder on an inner surface of the sleeve and, on the other side, the joining ring.

Another aspect of the invention relate to methods for producing barbells. A method in accordance with one embodiment of the invention includes the steps of: fitting a sleeve over an end portion of a shaft, wherein the sleeve comprises a cylindrical bore, an open end, and a should on its inner surface; fitting a supporting ring over the shaft and in the sleeve to abut the shoulder; attaching a joining ring to the end portion of the shaft such that it abuts the supporting ring; and attaching an end cap to the open end of the sleeve to enclose the end portion of the shaft, the supporting ring, and the joining ring inside the sleeve.

In some embodiments, the joining ring may be attached to the end of the shaft by thread engagement, and a pin is inserted through an off-center hole in the joining ring and into an off-center hole in the end of the shaft. In some embodiments, the joining ring may be attached to the end of the shaft by interference fit.

In any of the above embodiments, the supporting ring comprises a plurality of needle bearings. In any of the above embodiments, the shoulder may be formed by a flange on the inside surface of the sleeve or two bore sections having different diameters inside the sleeve. In any of the above embodiments, the end cap may be attached to the sleeve by thread engagement, interference fit, soldering, or the like.

Other aspects and advantages of the invention will be apparent from the following description and the appended claims.

BRIEF DESCRIPTION OF DRAWINGS

FIG. 3 shows a cross-sectional view of a bar assembly in accordance with one embodiment of the invention.

FIG. 4A shows a n end view of a shaft in accordance with one embodiment of the invention.

FIG. 4B shows a side view of the shaft of FIG. 4A.

DETAILED DESCRIPTION

Figure 1:
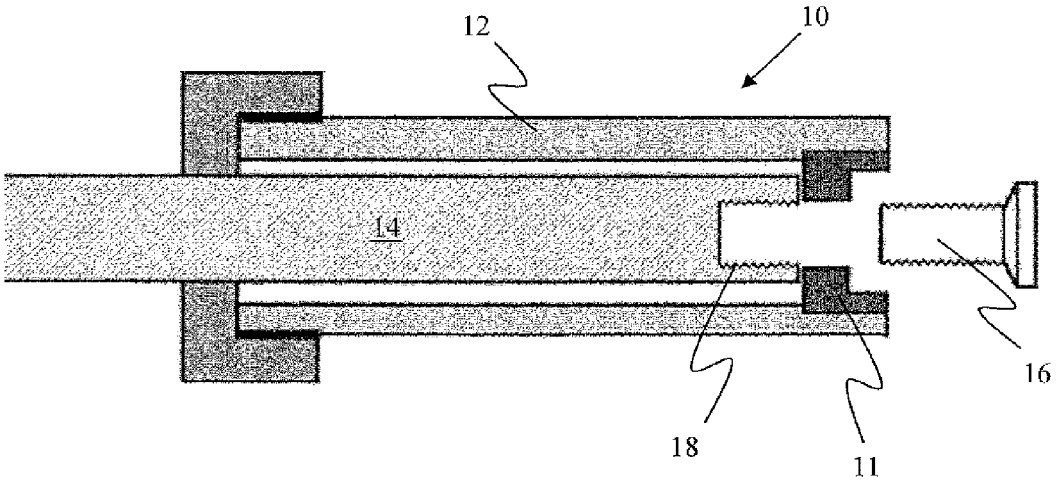
FIG. 1 (Prior Art)
FIG. 1 shows a cross-sectional view of a prior art bar sleeve.
Figure 2:
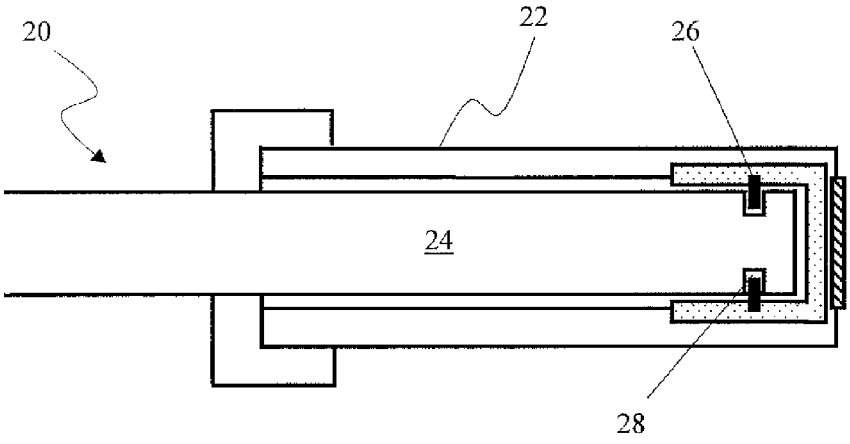
FIG. 2 (Prior Art)
FIG. 2 shows a cross-sectional view of another prior art bar sleeve.

Embodiments of the invention relate to barbells, such as Olympic bars, and methods for making such barbells. Although the following description use Olympic bars as examples to illustrate embodiments of the invention, one skilled in the art would know that embodiments of the present invention may also include other weight-lifting equipment, such as dumbbells and power-lifting bars.

As noted above, rotation mechanisms (such as bushing, ball bearings, and needle bearing) are included on Olympic bars to allow sleeves to rotate freely on the bars. In addition, the rotating sleeves are retained on shafts (handle bars) using a retention mechanism (e.g., bolts, pins, or snap rings) to prevent them from sliding off the ends of the bars. In the prior art Olympic bars, the rotation mechanism and the retention mechanism comprise separate structures.

Embodiments of the invention relate to Olympic bars having a novel, combined rotation-retention mechanism, which functions as both a rotation mechanism and a retention mechanism. Such a combined rotation-retention mechanism is based on interworking of several parts described below. The Olympic bars are more secure and more reliable. The following examples illustrate the interworking of the various parts. One skilled in the art would appreciate that these examples are for illustration only, and other modifications and variations are possible without departing from the scope of the invention.

FIG. 3 shows a cross-sectional view of an Olympic bar assembly 30 at one end of an Olympic bar in accordance with one embodiment of the invention. A similar bar assembly is disposed at the other end of the bar.

As shown in FIG. 3, bar assembly 30 in this example includes a sleeve 35 slides over a shaft 34 and covers a supporting ring 36 and a joining ring 38. An end cap 33 is attached to the distal end of the sleeve 35 to enclose the supporting ring 36 and the joining ring 38 inside the sleeve 35. The sleeve 35 may freely rotate about the shaft 34 around a longitudinal axis 31 of shaft 34.

The supporting ring 36 may be a cylindrical piece fits over the shaft 34 such that it can freely rotate around the shaft 34. The proximal end (the end towards the center of the Olympic bar) of the supporting ring 36 abuts a shoulder 53 formed inside the sleeve 35, while the distal end of the supporting ring 36 abuts the joining ring 38. The joining ring 38 is fixed to the end 34*a* of the shaft 34. The joining ring 38 may be fixed to the end 34*a* on the shaft 34 by a thread mechanism or other engagement mechanism (e.g., interference fit).

In the embodiment shown in FIG. 3, the supporting ring 36 plays dual functions. First, it functions as rotation mechanism (i.e., a bushing) to allow the sleeve 35 to freely rotate around the shaft 34. In addition, it also functions as a retention mechanism (like a roll pin or snap ring) to prevent the sleeve 35 from sliding in the longitudinal direction on the shaft 34.

To function as a retention mechanism, the supporting ring 36, at its proximal end 36*a*, abuts the shoulder 53 inside the sleeve 35, and the distal end 36*b* of the supporting ring 36 abuts the joining ring 38. The joining ring 38 is fixedly attached to the end portion 34*a* of the shaft 34. As a result, the supporting ring 36 cannot slide off the end of the shaft 34—because it is stopped by the joining ring 38. In turn, the supporting ring 36 prevents the sleeve 35 from sliding off the end of the shaft 34 because the sleeve 35, via is shoulder 53, bumps into the supporting ring 36.

On the other hand, the sleeve 35 is prevented from sliding further toward the center section of the shaft 34 because the end cap 33, which caps the distal end of the sleeve 35, abuts the joining ring 38 and would not be able to move past the joining ring 38.

Thus, by a novel arrangement of these components (the shoulder 53, the supporting ring 36, the joining ring 38, and the end cap 33), the sleeve 35 is prevented from sliding on the shaft 34 in the longitudinal direction. In this respect, the supporting ring 36 functions as a part of a retention mechanism to hold the rotating sleeve 35 in place (longitudinally) on the shaft 34. At the same time, the sleeve 35 (together with the end cap 33) is permitted to rotate freely around the shaft 34, and the supporting ring 36 functions as a bushing in this respect.

As noted above, the joining ring 38 may be threaded onto the end portion 34*a* of the shaft 34 or by other mechanisms. If the joining ring 38 is threaded on the end portion 34*a*, a pin 37 may be inserted, through an off-centered hole on the joining ring 38, into a matching off-centered hole 39 on the end portion 34*a* to prevent the joining ring 38 from unintentionally loosening due to rotation.

As shown in FIG. 3, Olympic bars according to embodiments of the invention rely on a combination of various components (an internal shoulder 53 inside the sleeve, a supporting ring 36, a joining ring 38, and an end cap 33) to retain the rotating sleeves 35 on the handle bars (shafts 34). The use of these separate components avoid the need for coaxial bolts to hold the sleeves in place. Furthermore, these components may be assembled from one end of the bar (the distal end), which allows one to assemble these components without any gap (clearance) commonly found in a roll pin or snap ring retention mechanism. The individual components and their assembly will be described in more detail in the following sections.

A handle bar of embodiments of the invention may be configured to attach with the joining ring 38 in any suitable manner that can securely hold the joining ring 38 in place. One such attachment mechanism may be by thread engagement. For example, FIG. 4(A) and FIG. 4(B) show an end view and a side view, respectively, of an end section 34*a* of a shaft 34. The end section 34*a* in this example is configured with a screw thread 33*a* for attachment of a joining ring 38 by a thread engagement. A thread engagement may come loose over time due to various forces causing relative rotation the parts. To prevent unintentional loosening of the joining ring 38, an off-center hole 39 may be provided on the end portion 34*a* for insertion of a pin 37. While this example shows a male thread on the end portion 34*a* for mating with a female thread on the joining ring 38, the reverse arrangement may also be used. Furthermore, while a thread engagement is shown in this example, other attachment means may also be used, such as a compression fit.

Figure 7A:
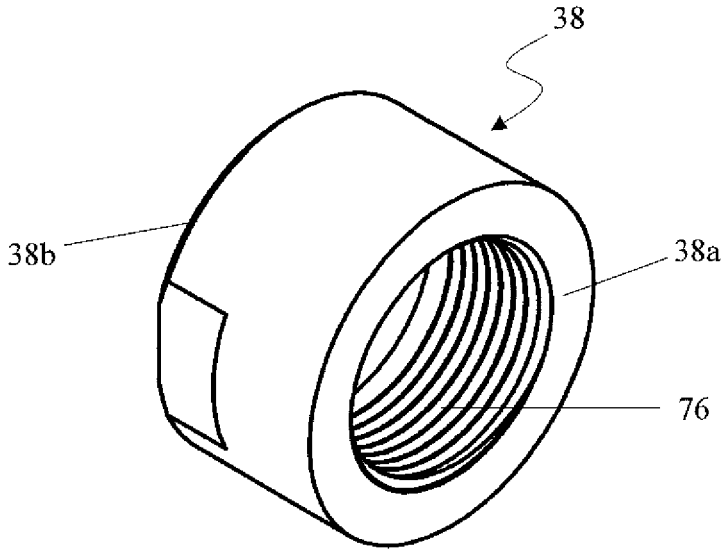
FIG. 7A shows a perspective view of a joining ring in accordance with one embodiment of the invention.
Figure 7B:
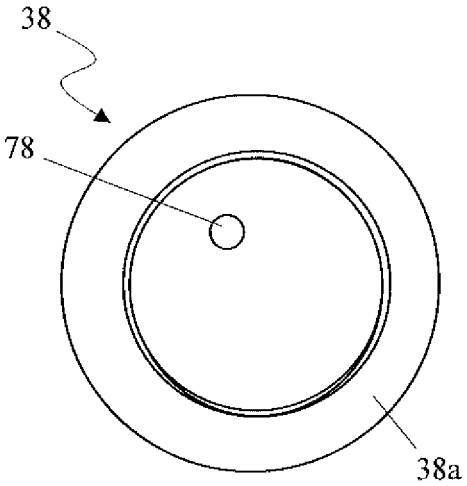
FIG. 7B shows an end view of the joining ring of FIG. 7A.
Figure 7C:
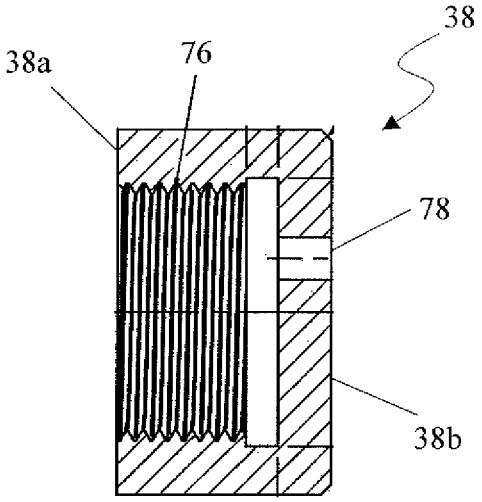
FIG. 7C shows a cross-sectional view of the joining ring of FIG. 7A.

In preferred embodiments, a joining ring is configured to be attached to the end portion of a bar by thread engagement, as shown in FIGS. 7A and 7C, which shows a perspective view and a front cross-sectional view of a joining ring 38, respectively. The joining ring 38 may have an open end 38*a* and a closed end 38*b* opposing to open end 38*a*. The internal surface 76 of the joining ring 38 may be configured to attach to the end portion 34*a* of shaft 34 by threaded engagement with the thread 33*a* on the end portion 34*a* (see FIG. 4B). Other configurations of internal surface 76, which allow joining ring 38 to be fastened to the end portion 34*a*, may be used, such as compression fit. When the joining ring 38 is securely fastened to the end portion 34*a*, its open end 38*a* would abut the distal end 36*b* of the supporting ring 36.

As noted above, when the joining ring 38 is threaded on the end portion 34*a*, the threaded engagement may become loosened due to free rotation of the sleeve 35. To eliminate this possibility, a pin 37 may be inserted through the joining ring 38 into the off-center hole 39 on the end portion 34*a* (FIG. 4A). FIG. 7B shows an end view from the open end 38*a*, illustrating an off-center hole 78, which matches the off-center hole 39 on the end portion 34*a* when the joining ring 38 is attached to the end portion 34*a*.

The joining ring 38 shown in the example of FIG. 3 and FIG. 7 has a cup shape to fit over an end of a shaft to provide a flange to abut the distal end of a supporting ring. One of ordinary skilled in the art would appreciate that other shapes of a joining ring may also be used as long as it can be fixed to the end of a shaft to provide a flange to abut the supporting ring. For example, a joining ring may be a simple plate/disc for attachment to the end of a shaft to provide a flange; the attachment may be by any suitable means, e.g., screws or bolts.

Figure 5:
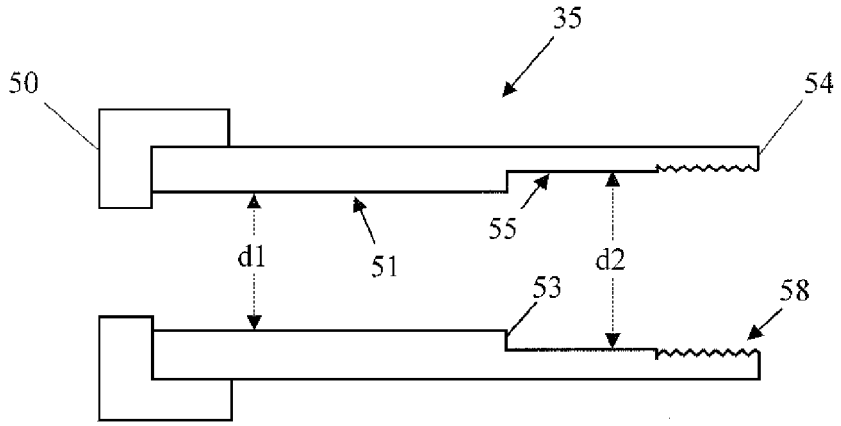
FIG. 5 shows a cross-sectional view of a sleeve in accordance with one embodiment of the invention.

As in any Olympic bar, a rotating sleeve is used to hold the weight plates on the bar while allowing for rotation. In accordance with embodiments of the invention, a rotating sleeve is configured to provide a shoulder to abut a supporting ring. The shoulder inside a sleeve may be provided by a flange (a ring of protrusion on the inside surface of the sleeve) or by different internal bores with different diameters. FIG. 5 shows a schematic of an example having different internal bores with different diameters.

As shown in FIG. 5, a sleeve 35 has a first bore section 51 with an inside diameter d1 configured to fit over the shaft 34 and a second bore section 55, which has a slightly larger diameter d2, such that a shoulder 53 is formed at the junction of the first bore section 51 and the second bore section 55*a*. The first bore section 51 is closer to the proximal end 50, while the second bore section 55 is closer to the distal end 54. The outer diameter of the sleeve 35 is sized to accommodate the center holes of weight plates/discs (not shown).

The inside diameter d2 of the second bore section 55 is sized to accommodate an assembly that includes the shaft 34, the supporting ring 36, and the joining ring 38 (see FIG. 3). The shoulder 53 is configured to abut the proximal end 36*a* of the supporting ring 36 (see FIG. 3). In this example, the shoulder 53 is formed by two bore sections 51 and 55 having different diameters. As noted above, in other examples, the shoulder 53 may be formed by a flange, while the first bore section 51 and the second bore section 55 may have the same diameter.

The sleeve 35 has an end section 58 for attaching an end cap 33. The internal surface of the third end section 58 may be configured with a female thread for attachment of the end cap 33, which has a matching male thread, by thread engagement. While this example shows that the end cap 33 fits inside the distal end 54 of the sleeve 35, one may also have the end cap 33 configured to fit on the outside of the distal end 54. Furthermore, in addition to thread engagement, the end cap 33 may also be configured to attach to the distal end 54 by other means, such as a compression fit or soldering.

Figure 8A:
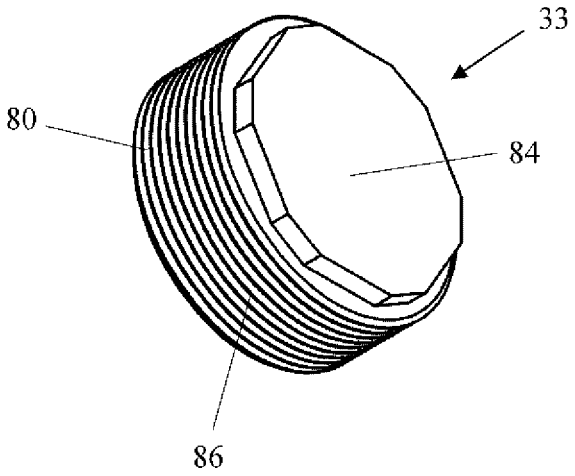
FIG. 8A shows a perspective view of an end cap in accordance with one embodiment of the invention.
Figure 8B:
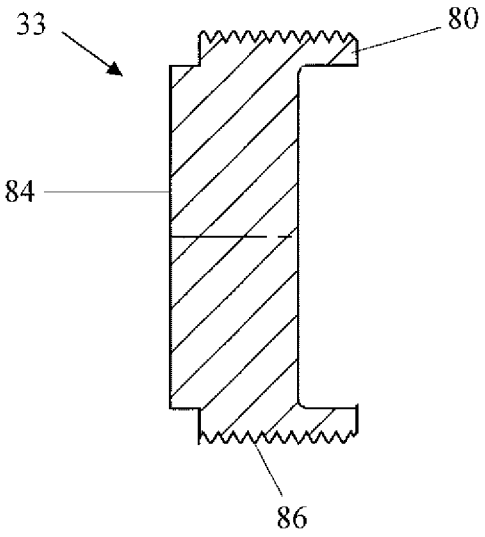
FIG. 8B shows a cross-sectional view of the end cap of FIG. 8A.

The function of the end cap 33 is to enclose the rotation-retention mechanism inside the sleeve 35 and also to prevent the sleeve 35 from sliding towards the center of the Olympic bar. FIGS. 8A and 8B show a perspective view and a cross-sectional view of an end cap 33, respectively, in accordance with one embodiment of the invention. The end cap 33 has a proximal end 80 and a closed end 84. At least a part of the external surface 86 of the end cap 33 is configured for attachment to the distal end 54 of sleeve 35. Any configurations of the external surface 86 suitable for secure attachment to the sleeve 35 may be used. Some embodiments of the invention may include an end cap 33 with an externally threaded surface 86 configured to be threaded into an internally threaded surface of the end section 58 of the sleeve 35, as noted above. While this example shows that the end cap 33 is attached to the inside of the sleeve 35, in an alternative embodiment, the end cap 33 may be attached to the outside of the sleeve 35. Furthermore, the end cap 33 may be attached to the sleeve 35 by other mechanisms, such as interference fit, soldering, or similar methods.

Figure 6:
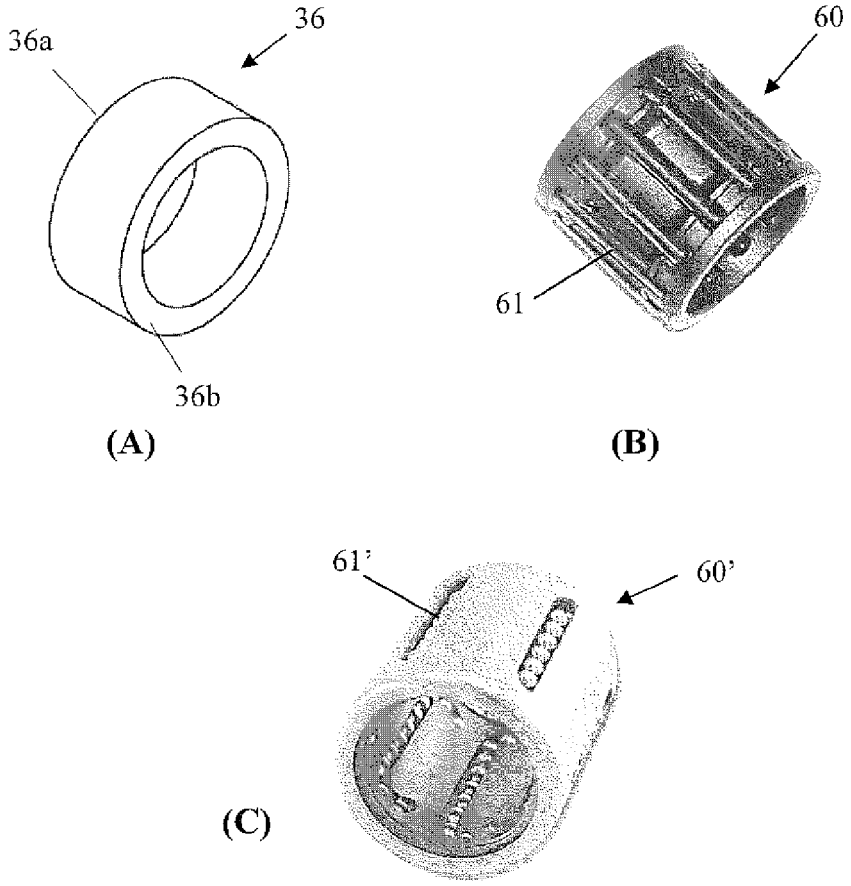
FIG. 6A shows a perspective view of a supporting ring in accordance with one embodiment of the invention.
FIG. 6B shows a perspective view of another supporting ring in accordance with one embodiment of the invention.
FIG. 6C shows a perspective view of yet another supporting ring in accordance with one embodiment of the invention.

As noted above, a supporting ring 36 in accordance with embodiments of the invention may have a dual function—as part of a rotation mechanism and as part of a retention mechanism. FIG. 6A shows a perspective view of a supporting ring 36, which is an annular bushing, includes a proximal end 36*a* and a distal end 36*b*. The supporting ring 36 is configured to fit over the shaft 34 and is disposed in the second bore section 55 of the sleeve 35 such that its proximal end 36*a* abuts the shoulder 53. The supporting ring 36 may reinforce the strength of the sleeve 35 and the shaft 34 when weight plates are loaded. In this example, the supporting ring 36 is a bushing, having a structure of a simple tubular section. In other examples, the supporting ring 36 may further comprise roller pins (i.e., needle bearings), as shown in FIG. 6B, which shows a supporting ring 60 having a plurality of needle bearing 61. Similarly, one may have ball bearings, instead of needle bearings, in a configuration similar to that of supporting ring 60. For example, FIG. 6C shows an embodiment of a supporting ring 60' having a plurality of ball bearings 61'.

While only one supporting ring 36 is shown in the example in FIG. 3, other embodiments of the invention may include two or more supporting rings 36. In addition, embodiments of the invention may further include other rotation mechanisms, such as bushings, ball bearings, and needle bearings, or a combination thereof.

Figure 9:
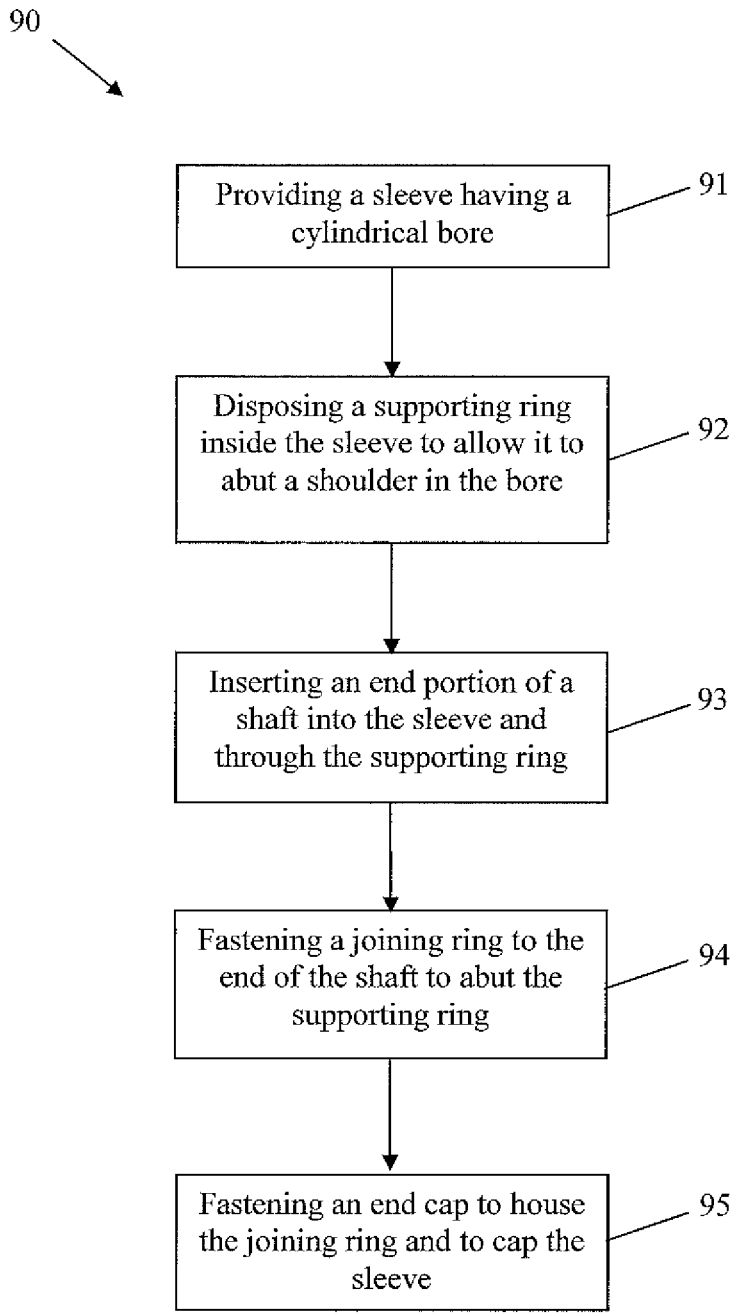
FIG. 9 shows a method in accordance with an embodiment of the invention.

Some embodiments of the invention relate to methods for making a barbell, such as an Olympic bar. FIG. 9 shows a method 90, which may include steps of providing a sleeve having a cylindrical bore, wherein the sleeve includes an internal shoulder (step 91); disposing a supporting ring inside the sleeve such that a proximal end of the supporting ring abuts the shoulder (step 92); inserting an end portion of the shaft into the sleeve and the supporting ring (step 93); fastening a joining ring to the end portion of the shaft such that it abuts the supporting ring (step 94); and fastening an end cap to cap the distal end opening of the sleeve (step 95). The above-described method is for illustration only and other variations and modifications to this method are possible without departing from the scope of the invention. For example, the steps need not be performed in the order described, and one may insert the shaft into the sleeve before sliding the supporting ring onto the shaft.

The above description illustrates various embodiments of the invention. One skilled in the art would appreciate that these examples are for illustration only, and other modifications are possible without departing from the scope of the invention.

Advantages of embodiments of the invention may include one or more of the following. Olympic bar assemblies of the invention may allow for more secure bars due to the interworking of parts, e.g., supporting rings, joining rings, pins, and end caps. Embodiments of the invention include Olympic bar assemblies do not use coaxial bolts to retain the rotating sleeves on the shafts. Therefore, the risk for parts to be loosening may be reduced. In addition, because sleeve rotation may become smoother, squeaking noises may be reduced. Moreover, embodiments of the invention include Olympic bar assemblies that do not use roll pins and snap rings to secure shaft to sleeve, eliminating any gaps between roll pin and snap ring inserts and grooves. Therefore, there will not be sliding motion of sleeves.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A barbell comprising a bar assembly that comprises:

a sleeve rotatably fitted over a rotating-locking mechanism at an end of a shaft; and an end cap attached to an open end of the sleeve to enclose the rotating-locking mechanism and the end of the shaft inside the sleeve, wherein the rotating-locking mechanism comprises a supporting ring rotatably fitted over the shaft and a joining ring attached to the end of the shaft, wherein the supporting ring abuts, at a first end of the supporting ring, a shoulder on an inner surface of the sleeve and abuts the joining ring at a second end of the supporting ring, wherein the joining ring includes threads on an internal surface and is attached to the end of the shaft by thread engagement, and a pin is inserted through an off-center hole in the joining ring and into an off-center hole in the end of the shaft to prevent the joining ring from rotating around the shaft.

2. The barbell of claim 1, wherein the supporting ring comprises a bushing.

3. The barbell of claim 1, wherein the supporting ring comprises a plurality of needle bearings.

4. The barbell of claim 1, wherein the supporting ring comprises a plurality of ball bearings.

5. The barbell of claim 1, wherein the shoulder is formed by two bore sections having different diameters inside the sleeve.

6. The barbell of claim 1, wherein the shoulder is formed by a flange inside the sleeve.

7. The barbell of claim 1, wherein the end cap is attached to the sleeve by thread engagement.

8. The barbell of claim 1, wherein the barbell is an Olympic bar.

9. A method for producing a barbell, comprising:

fitting a sleeve over an end portion of a shaft, wherein the sleeve comprises a cylindrical bore, an open end, and a shoulder on its inner surface;

fitting a supporting ring over the shaft and in the sleeve to abut the shoulder;

attaching a joining ring to the end portion of the shaft such that it abuts the supporting ring; and attaching an end cap to the open end of the sleeve to enclose the end portion of the shaft, the supporting ring, and the joining ring inside the sleeve, wherein attaching the joining ring to the end portion of the shaft is by threading the joining ring onto a threaded end portion of the shaft and inserting a pin inserted through an off-center hole in the joining ring and into an off-center hole in the end of the shaft to prevent the joining ring from rotating around the shaft.

10. The method of claim 9, wherein the supporting ring comprises a bushing.

11. The method of claim 9, wherein the supporting ring comprises a plurality of needle bearings.

12. The method of claim 9, wherein the supporting ring comprises a plurality of ball bearings.

13. The method of claim 9, wherein the shoulder is formed by two bore sections having different diameters inside the sleeve.

14. The method of claim 9, wherein the shoulder is formed by a flange inside the sleeve.

15. The method of claim 9, wherein attaching the end cap is by threading the end cap to the open end of the sleeve.

16. The method of claim 9, wherein the barbell is an Olympic bar.

* * * * *